United States Patent [19]

Hanniala

[11] Patent Number: 4,645,186

[45] Date of Patent: Feb. 24, 1987

[54] APPARATUS FOR PROCESSING SULPHIDE CONCENTRATES AND SULPHIDE ORES INTO RAW MATERIAL

[75] Inventor: Teuvo P. T. Hanniala, Espoo, Finland

[73] Assignee: Outokumpu Oy, Helsinki, Finland

[21] Appl. No.: 827,264

[22] Filed: Feb. 7, 1986

Related U.S. Application Data

[62] Division of Ser. No. 753,399, Jul. 10, 1985.

[30] Foreign Application Priority Data

Jul. 18, 1984 [FI] Finland ..... 842882

[51] Int. Cl.[4] ..... C21C 1/00; C22B 15/00

[52] U.S. Cl. ..... 266/212; 75/73; 266/215; 266/242

[58] Field of Search ..... 266/212, 215, 242; 75/73

[56] References Cited

U.S. PATENT DOCUMENTS 3,459,415 8/1969 Holeczy ..... 75/73
3,527,449 9/1970 Worner ..... 75/73
3,664,828 5/1972 Worner ..... 75/73
4,139,371 2/1979 Makipirtti ..... 75/73
4,470,845 9/1984 Yannopoulos ..... 75/73

*Primary Examiner*—Peter D. Rosenberg
*Attorney, Agent, or Firm*—Brooks Haidt Haffner & Delahunty

[57] ABSTRACT

The present invention relates to a method and apparatus for treating sulphide concentrates of sulphide ores in order to produce raw metal in one and the same process unit (1). According to the invention, the molten matte (5) received from suspension smelting is solidified (7) and, if necessary, crushed (8) and ground (9), whereafter the solid matte (5) is returned into the process unit (1) through the converting shaft (10) located therein. In the converting zone (15) the matte (5) is converted into raw metal (12) by means of a two-phase method. The exhaust gases both from the smelting zone (16) and from the converting zone (15) are discharged through a common uptake shaft (4). Moreover, the slags (6,11) from both zones can be discharged through the same tap hole (17), whereas the matte (5) and the raw metal (11) are advantageously removed from the process unit (1) each through a specific individual tap hole (18,19).

3 Claims, 3 Drawing Figures

Figure 1:
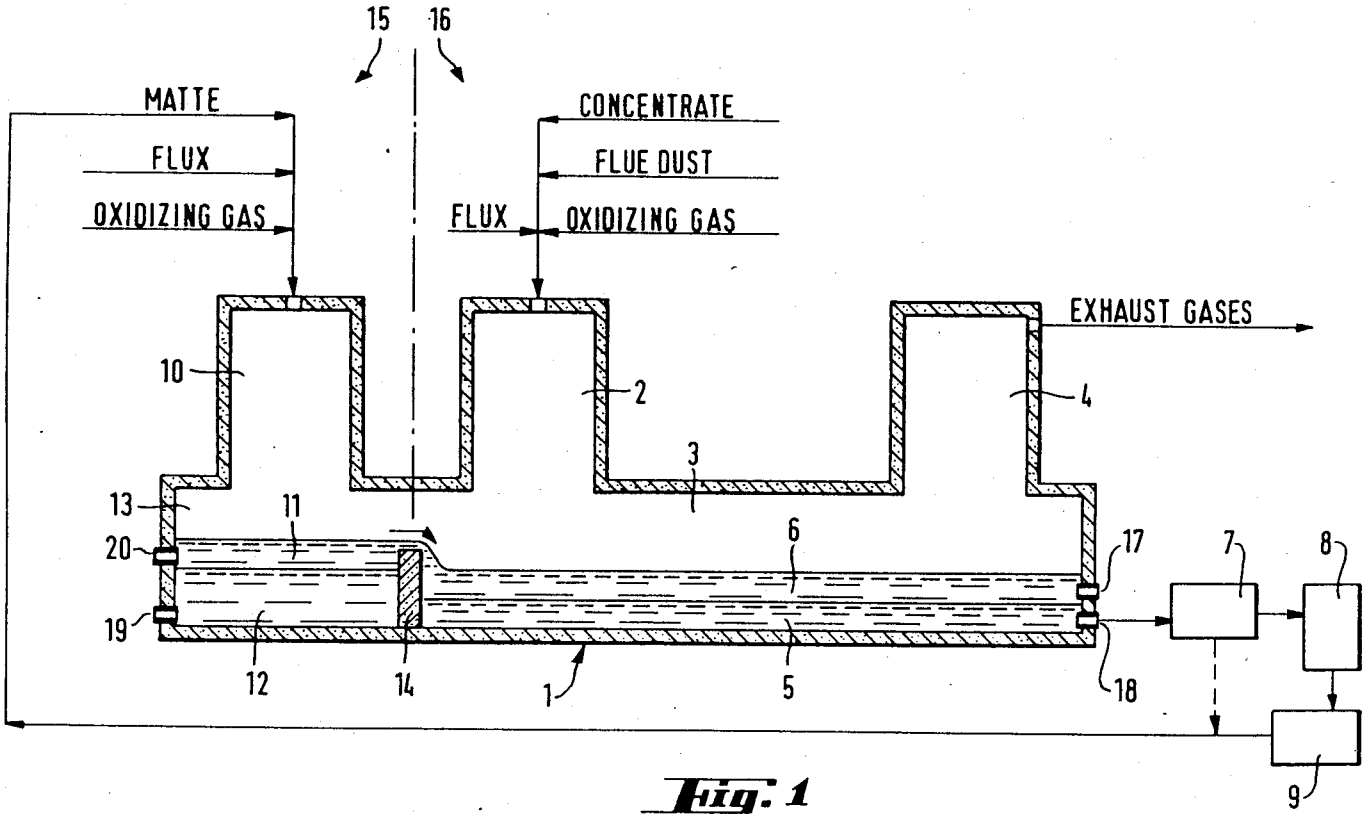

APPARATUS FOR PROCESSING SULPHIDE CONCENTRATES AND SULPHIDE ORES INTO RAW MATERIAL

This is a division of application Ser. No. 753,399 filed July 10, 1985.

The present invention relates to a method and apparatus for processing sulphide concentrates and sulphide ores into raw metal, first by oxidizing the material into matte and thereafter by converting the obtained matte further into raw metal in the same process unit.

In conventional copper production, the sulphide matte received from the smelting unit is conveyed in molten state in a ladle into an oxygen-blowing converter, such as the Pierce-Smith converter. In this converter, the sulphide matte is processed into raw metal, preferably in two stages: the slag-blowing period and the metal-blowing period. However, the conventional method of copper production has a few drawbacks, and efforts have been made to eliminate them in various different ways.

In conventional copper production, the transport of molten matte from the smelting unit into the converter causes sulphur dioxide gases to be discharged into the smelter. Converting as such is also a batch process and the gases formed therein must be cooled off, generally by means of air dilution and indirect cooling methods. Thus large quantities of the diluted gases pass on to the gas treatment plant, which must be built relatively spacious according to the said gas quantities which are large compared to the product quantities received from the gas treatment plant such as a sulphuric acid plant. In the converting, compressed air is used for blowing, and it is not possible to use a great oxygen-enrichment of the blowing air, which in part increases gas quantities to be used. The blowing technique employed in conventional converting ensures a satisfactory mixing, which, however, when combined to a minimal separation of slag and blister copper, results in substantial copper losses in the slag. Furthermore, the method of conventional converting is based on experience rather than on controlled scientific-technical processing. Moreover, owing to the cyclic nature of the converting, the lack of cooling-off techniques, as well as melt blowing, it is often necessary to carry out relining within the converter.

Efforts have been made to eliminate the drawbacks of conventional copper production by means of the so-called direct copper production methods. The known direct methods are developed, among others, by the Japanese Mitsubishi and the Canadian Noranda. The Mitsubishi process is carried out in three interconnected furnaces: a smelting furnace and a converting furnace, and an electric furnace installed therebetween for the slag cleaning of the smelting furnace. According to this method, melt flows in a continuous stream from the smelting furnace into the electric furnace, whereafter the sulphide matte flows further from the electric furnace into the converter, and blister copper, as the final product receives from the process, flows out of the converter. However, in the converter of the Mitsubishi method, wherein lance technique is applied, the specific capacity of oxygen is low, wherefore the converter must be built roughly three times as big as the converter in ordinary copper production.

In the Noranda process, the production of blister copper is carried out in a cylindrical furnace of the type of the Pierce-Smith converter. The granulated sulphide concentrate and flux are conveyed to the furnace through the charging end, so that the feed covers approximately half of the surface of the melt located within the furnace. The blowing with air or with oxygen-enriched air takes place in similar fashion as in an ordinary horizontal converter, through tuyeres located at the side. According to the Noranda process, the bottom of the rear of the furnace is some what raised, so that only slag is discharged through the other end opposite to the charging end. Along with the formation of blister copper, copper is tapped out through the tapping hole located in the middle of the furnace, whereas slag is discharged in a continuous flow. But the obtained blister copper contains a remarkable amount, about 1,5% by weight sulphur, so that the copper must be separately raffinated before electrolysis.

The method of direct production helps to eliminate some of the drawbacks of conventional copper production, for example the sulphur dioxide gas discharges into the working space and the batchlike nature of the process but the direct method also brings forth new drawbacks in addition to those mentioned above. Such drawbacks are, for instance, the high impurity concentrations in the produced raw metal, as well as the difficulties in treating the resulting slag—owing to the high magnetite content thereof.

The U.S. Pat. No. 4 416 690 introduces a copper production method where matte received from the smelting unit is first solified for instance by granulating, whereafter the ground, solid matte is further fed into the oxygen-blowing converter together with flux. This allows for a largescale treatment of the matte before the converting stage, and eliminates the disadvantages which would be caused by gases flowing into the working space during the transport operation. In the U.S. Pat. No. 4 416 690, the smelting unit and the converting unit are located at a considerable distance from each other, which arrangement enables an advantageous factory-scale planning according to the special circumstances at the respective localities, but on the other hand, the separation of the units leads to increased personnel expenses. Moreover, the treatment of the slags received from the separate process units in order to clean the slag of valuable metals is difficult to arrange, because an economical treatment would require the combining of these two contingencies of slag. Furthermore, a separate converting unit requires a fair amount of external energy during the preheating operation.

The U.S. Pat. No. 3 674 463 introduces a continuous method for producing blister copper, in which method the matte received from smelting is fed in molten state back into the converting zone which has been formed in the smelting unit. The converting zone can be either common with the smelting zone, or separate thereof. If the converting and smelting zones are combined, the matte is fed into the reaction shaft of the suspension smelting furnace which advantageously serves as the smelting unit. In the case of separate smelting and converting zones, the drawing of the U.S. Pat. No. 3 674 463 illustrates the possibility to employ a specific converting shaft along with the previously known suspension smelting furnace, and the reaction shaft and uptake shaft of the flash smelting furnace. However, the treatment of molten material brings forth some drawbacks, for instance in the form of sulphur dioxide gases which may enter the working space. Moreover, the feeding of the molten material causes the quantities of gas contained within the converting zone to be remarkably large, wherefore the separate converting shaft, for example, must be built large—as well as the gas treatment equipment after the furnace. Furthermore, the feeding of molten matte requires that the sulphide concentrate must be fed into the settler, at the bottom part of the reaction shaft, in order to adjust the temperature so that it is suitable for carrying out the process.

The object of the present invention is to eliminate the drawbacks of the prior art and to achieve an improved method for treating sulphide concentrates and sulphide ores, as well as an apparatus for applying the method so that raw metal is produced in the same unit whereinto the material to be treated is fed. The method of the invention is characterized by the novel features apparent from the appended patent claim 1, and the apparatus of the invention is characterized by the novel features apparent from the patent claim 7.

In the method of the invention, the sulphide concentrate or sulphide ore to be treated, along with the flux and oxidizing gas, as well as circulated flue dust, are first fed into a suspension smelting furnace in order to produce molten matte, which in a conventional process is fed further into an oxygen-blowing converter. According to the present invention, however, the molten matte is removed from the furnace and solidified into fine particles of matte, preferably by means of granulating or atomizing. The resulting solid matte is crushed, if necessary, and thereafter ground to conform a grain size which is suitable for feeding the material into the subsequent converting stage. According to the method of the invention, the solid matte having a suitable grain size, together with the flux and oxidizing gas, is fed back into the suspension smelting furnace used in the production of matte, through the second reaction shaft, i.e. the converting shaft, formed therein, in order to convert the matte into raw metal. The raw metal can advantageously be for instance blister copper or high-grade nickel matte received as a middling in nickel production. The second reaction shaft of the suspension smelting furnace which shaft is employed for converting, is in a preferred embodiment of the invention placed, with respect to the conventional reaction shaft and uptake shaft, so that the conventional reaction shaft remains between the reaction shaft employed for converting and the uptake shaft. By means of using the converting shaft, it is possible to create a separate converting zone within the suspension smelting furnace, so that at least the gas space of the said converting zone is common with the matte production zone. On the other hand, preferably at least the molten matte and the molten raw metal located in the settler of the suspension smelting furnace are separated from each other. Thus the raw metal produced in the converting zone can be discharged through a specific tap hole, whereas the slag from the converting zone is advantageously let to flow into the slag from the smelting zone and be mixed therein, whereafter it is discharged from the furnace through the outlet for smelting zone slag into further treatment, or it is let out through a particular tap hole and thereafter cooled, crushed, ground and fed back into the smelting zone together with the sulphidic raw material.

The converting shaft does not necessarily have to be located at the end of the suspension smelting furance, but it can also be connected to the settler through the side wall of the suspension smelting furnace without causing any essential disadvantage to the method of the invention. In that case the mutual positions between the reaction shaft of the suspension smelting furnace, the uptake shaft and the converting shaft can also be changed.

According to the invention, by feeding the fine-grained solid matte into the same process unit where the matte is produced, the oxygen efficiency is improved compared to the method suggested in the U.S. Pat. No. 4 416 690 because the excessive oxygen created in converting can be utilized at the bottom part of the reaction shaft proper while producing matte. In addition to this, the slag from the converting unit is mixed in molten state with the slag from the smelting zone, so that the slag combination becomes homogenous which is advantageous with respect to any possible further treatment of the slag. Owing to good mixing, the fluidity of the slag from the converting zone is also improved, so that slag discharge from the furnace is easier. In the preferred embodiment of the method of the present invention, advantageously only the surface portion of the converting zone slag is free to flow into the smelting zone, and therefore metal losses into the slag can be essentially reduced. Thus the recovery of metal into the raw metal phase is increased.

By employing the method of the invention for feeding the solid, finelyground matte back into the same process unit for converting, in the converting zone there is advantageously achieved an equilibrium between only two phases, i.e. between the slag and the raw metal. The sulphur content of the raw metal produced in this fashion remains lower than in the case where the three-phase method (slag-matte-raw metal) is applied; a prior art example of the latter is the method introduced in the U.S. Pat. No. 3 674 463. In the method of the U.S. Pat. No. 3 674 463, where a specific converting shaft is used, the slags from the smelting zone and the converting zone are not separated from each other, and consequently the impurity concentrations in the produced raw metal are higher than with the method of the present invention. Moreover, in the present invention solid matte is fed into the converting shaft, which makes it unnecessary to control the temperature and oxygen content in the settler of the process unit by feeding concentrate into the settler.

Thus the method of the invention provides improved possibilities for producing raw metal with less impurities than in the prior art from concentrates containing impurities such as arsenic, antimony, bismuth, lead and zinc. By bringing the advantages of suspension smelting into both primary smelting and converting, and by returning the flue dust separated from the exhaust gases into the correct stage in the process, the method of the invention can be applied for producing an improved raw metal product even from raw materials containing large amounts of impurities.

In suspension smelting, the reaction velocities are high, and the so-called scrubbing effect of the gases with respect to the material is strong. Combined, these features provide for an advantageous evaporation of for instance arsenic, antimony and bismuth. In the method of the invention, both the raw material and the matte received from the smelting zone are put through suspension smelting, so that the copper content of the matte produced at the smelting stage can be so adjusted that the impurities are removed as completely as possible. Lead and zinc are easily oxidized, and in the oxide state they pass on into the slag. Slagging is regulated by the activity of copper in the matte, and consequently the lead and zinc concentrations in the slag are increased if the copper content of the matte is raised.

Figure 3:
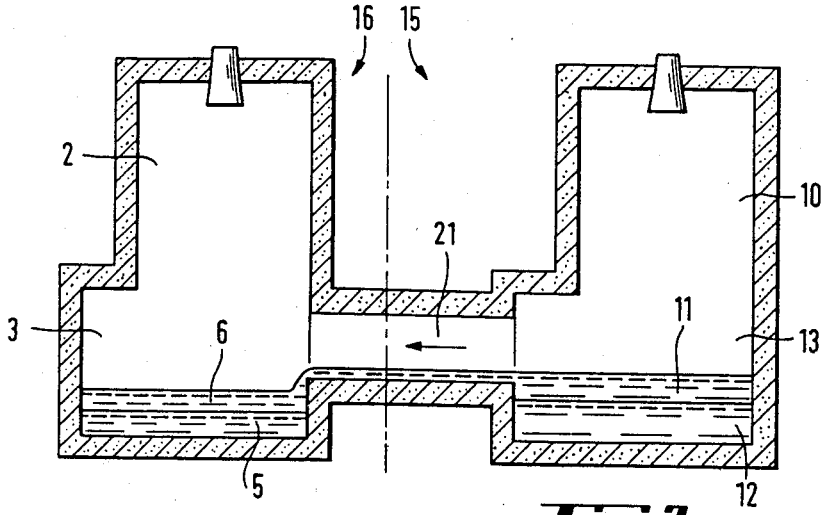
Figure 2:
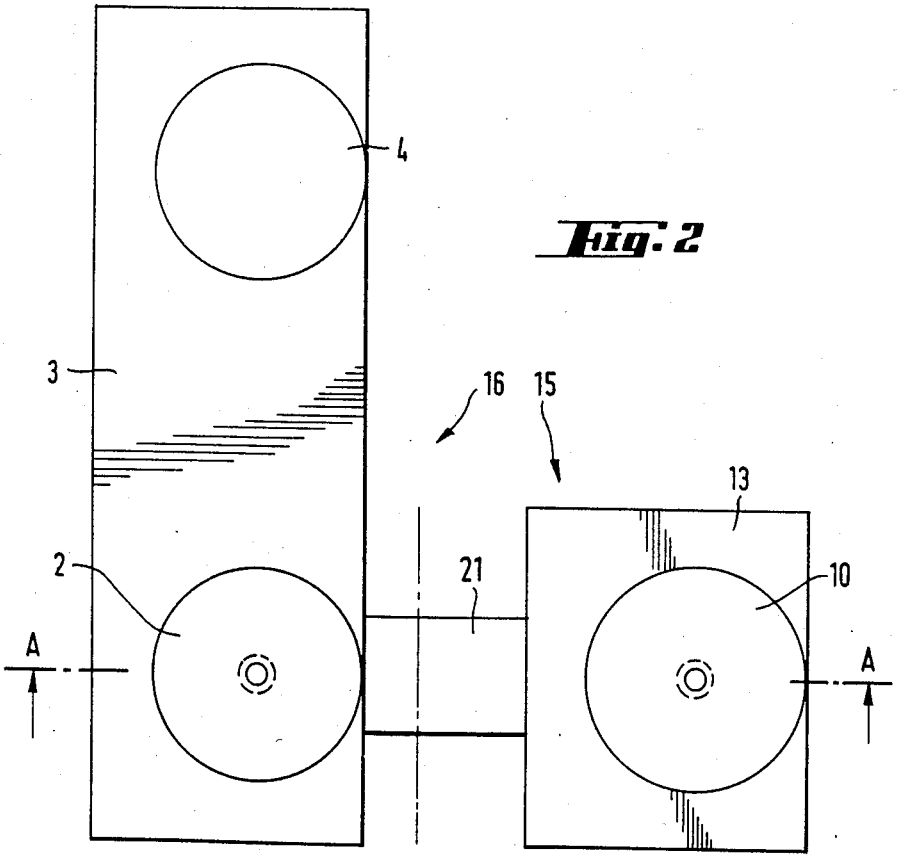

The invention is explained in more datail below with reference to the appended drawings where FIG. 1 is a schematical illustration of a preferred embodiment of the invention seen from the side as well as a flowsheet of materials which is related thereto, FIG. 2 is a schematical illustration of another preferred embodiment of the invention seen from the top, and FIG. 3 is an illustration of the embodiment of FIG. 2 seen along the section A—A.

According to FIG. 1, the sulphide raw material, together with the flux, oxidizing gas and flue dust is fed into the process unit such as the flash smelting furnace 1 through the reaction shaft 2 in order to produce molten matte 5 into the settler 3 in the smelting zone 16 of the process unit. The formation of matte takes place in a well-known fashion, so that on top of the matte phase there is formed the slag phase 6 which is discharged through the tap hole 17. The sulphur dioxide-bearing exhaust gases resulting from the production of matte are discharged from the processing unit 1 through the uptake shaft 4.

The produced matte 5 is conducted out of the settler 3 through the tap hole 18 and is fed into granulation 7, where the matte is solidified into small particles. If necessary, the received granulating product is crushed and ground by means of the devices 8 and 9, whereafter it is conveyed to be charged into the converting shaft 10. The ground solid matte is further charged, along with flux and oxidizing gas, into the converting shaft 10, which according to the drawing 1 is placed at the end of the processing unit 1 and in which shaft the feed is formed into two molten phases, i.e. the slag 11 and the raw metal 12. The molten phases settle down to the settler 13 of the converting zone 15, whereas the created exhaust gases pass on to the settler 3 of the smelting zone and further into the uptake shaft 4. In between the settler 3 of the smelting zone and the settler 13 of the converting zone, there is arranged the partition wall 14 in order to prevent the matte 5 and the raw metal 12 from getting mixed. In addition, the partition wall 14 is advantageously so high that the slag 6 from the smelting zone is obstructed from flowing into the converting zone 15, but at the same time so low that the layer located on the surface of the slag phase 11 of the converting zone can flow into the settler 3 of the smelting zone and be mixed into the slag 6 located therein. Thus the slag 11 from the converting zone can be discharged through the tap hole 17. If desired, a specific tap hole 20 can be arranged for the slag 11. The produced raw metal 12, however, is advantageously tapped only through the specific tap hole 19.

In the preferred embodiment of FIGS. 2 and 3, the converting zone 15 is separated from the smelting zone 16 by means of the connecting duct 21. The connecting duct 21 is preferably designed so that the flowing of the phases formed in the smelting zone 16 and the converting zone 15, with respect to each other, takes place as is indicated in FIG. 1. Thus for instance the slag 11 from the converting zone can flow through the connecting duct 21 into the smelting zone 15 and be mixed with the slag 6 thereof.

The method of the invention can also be observed by aid of the following examples which are based on experimental results.

EXAMPLE 1

Sulphidic copper concentrate containing 27,9% by weight copper, 28,7% by weight iron, 29,9 % by weight sulphur and 6,7% by weight $SiO_2$, was fed into the reaction shaft of a flash smelting furnace together with flux and oxidizing gas. The employed oxidizing gas was oxygen-enriched air, the degree of enrichment whereof was 37,9%. The appended Table 1 gives an overall material balance of the method of the invention per fed ton of concentrate. Part A of Table 1 represents the feeding of material into the reaction shaft of a primary flash smelting furnace. The material concentrations measured in the reaction shaft of the flash smelting furnace are presented in Part C of Table 1, together with the production output figures from the converting zone. The feed input figures in the converting shaft of the invention are enlisted in Part B of the Table 1.

TABLE 1

Material balance of the example

| | | | |
|---|---|---|---|
| A. | Reaction shaft feed | | |
| | Concentrate | kg | 1000 |
| | Flue dust | kg | 93,7 |
| | Flux | kg | 93,7 |
| | Process air | Nm3/t | 435,9 |
| | temperature | °C. | 200 |
| | Technical oxygen | Nm3/t | 125,0 |
| | temperature | °C. | 200 |
| | Degree of oxygen-enrichment | % | 37,9 |
| B. | Converting shaft feed | | |
| | Matte | kg | 396,9 |
| | Cu-concentration | % | 70,0 |
| | Flux | kg | 18,9 |
| | Process air | Nm3/t | 26,6 |
| | temperature | °C. | 25 |
| | Technical oxygen | Nm3/t | 65,6 |
| | temperature | °C. | 25 |
| | Degree of oxygen-enrichment | % | 74,1 |
| C. | Settlers | | |
| | Matte from converting zone settler | kg | 396,9 |
| | Cu-concentration | % | 70,0 |
| | Slag from converting zone to smelting zone | kg | 62,5 |
| | Cu-concentration | % | 8,0 |
| | Slag total | kg | 667,2 |
| | Cu-concentration | % | 2,3 |
| | Blister copper | kg | 278,1 |
| | Exhaust gases from uptake shaft | Nm3/t | 609,4 |
| | temperature | °C. | 1280 |

According to the method of the invention, the high-grade matte (70% by weight Cu) received from the settler of the flash smelting furnace was let out of the smelting unit in batches. This high-grade matte was immediately conducted into granulation, and the resulting product was crushed and ground. The created solid, finely-ground granulation product was further fed back into the flash smelting furnace, into the converting shaft thereof (Table 1, Part B). Because the converting shaft, and the converting zone alike, where arranged in connection with the flash smelting furnace, there was no need for preheating the converting zone although the emplyed feed was a solid granulation product. Similarly there was no need for feeding material into the converting stage only in order to regulate the temperature within the furnace. The final product from the process of the invention, i.e. blister copper, formed an equilibrium in the settler of the converting zone directly with the slag phase; the three-phase equilibrium typical of conventional copper production was not created. The resulting blister copper was tapped out through a specific tap hole, whereas the slag from the converting zone was allowed to flow as overflow into the slag from the smelting zone and be mixed therein, so that the removal of the converting zone slag from the process and the regulation of the copper concentration thereof could be carried out more easily.

From Table 1 it is apparent that by employing the method of the present invention, a minimum of 94,5% by weight of the fed copper content was recovered as blister copper. The respective degree of recovery, based on the readings given in the specification of the U.S. Pat. No. 4 416 690, was 93,3% maximum. This makes a remarkable difference when the large volume of production is considered.

EXAMPLE 2

This example relates to the more detailed illustration of the impurity distribution between the separate phases when applying the method of the invention in accordance with the example 1. The analysis of the main components in the feeding concentrate was the same as in the example 1, but this analysis is more detailed with respect to the impurities: 27,9% by weight Cu, 28,7% by weight Fe, 29,9% by weight S, 6,7% by weight $SiO_2$, 0,31% by weight As, 0,09% by weight Sb, 0,009% by weight Bi, 1,48% by weight Pb and 3,96% by weight Zn.

The employed exidizing gas was oxygen-enriched air, the enrichment degree whereof was 37,9%. The quantity of the matte which was fed to the converting zone, was 396,9 kg per fed ton of concentrate. This high-grade matte (70% by weight Cu) contained as impurities 0,32% by weight As, 0,059% by weight Sb, 0,018% by weight Bi, 3,3% by weight Pb and 1,2% by weight Zn.

The quantity of the blister copper produced in the process unit of the invention was 278,1 kg and the blister copper contained as impurities 0,6% by weight S, 0,22% by weight As, 0,073% by weight Sb, 0,020% by weight Bi, 0,32% by weight Pb and 0,01% by weight Zn. The slag quantity which was tapped from the furnace, was 667,2 kg and its analysis for copper and impurities was the following: 2,3% by weight Cu, 0,15% by weight As, 0,083% by weight Sb, 0,003% by weight Bi, 2,0% by weight Pb and 5,9% by weight Zn.

On the ground of the results it can be proved, that the quantity of arsenic in the blister was about half of the quantity of arsenic in the matte. The contents of bismuth and lead were decreased by one third part, the degree of the removal of antimony was smaller. Zinc was removed almost completely from the blister copper.

I claim:

1. An apparatus for processing sulphide concentrates and sulphide ores into raw metal within the same process unit comprising means for feeding sulphide material to be treated, flux and oxidizing gases into a smelting zone to produce a molten slag phase and a molten sulphide matte within said smelting zone, a converting zone for converting solid matte into raw metal, at least one partition member between said smelting and converting zones, said partition member being of such a height that molten slag from said smelting zone is obstructed from flowing into said converting zone, but slag from said converting zone is allowed to flow over said partition member into said smelting zone for mixing with slag in said smelting zone, said partition member preventing contact between raw metal in said converting zone and molten matte in said smelting zone, and said partition member allowing space for gases to flow thereover from said converting zone to said smelting zone, and means for discharging phases produced from said smelting unit.

2. The apparatus of claim 1 wherein the partition member is a partition wall.

3. The apparatus of claim 1 wherein the partition member is a connecting duct.

* * * * *

UNITED STATES PATENT AND TRADEMARK OFFICE

CERTIFICATE OF CORRECTION

PATENT NO. : 4,645,186

DATED : February 24, 1987

INVENTOR(S) : Teuvo P.T. Hanniala

It is certified that error appears in the above-identified patent and that said Letters Patent is hereby corrected as shown below:

The Finnish Application of which priority is claimed is incorrectly shown as "842882". This information should read:

--[30] Foreign Application Priority Data

Jul. 18, 1984 [FI] Finland.....842883--.

Signed and Sealed this

Twenty-second Day of December, 1987

*Attest:*

DONALD J. QUIGG

*Attesting Officer*

*Commissioner of Patents and Trademarks*